United States Patent [19]

Reich et al.

[11] Patent Number: 4,957,413

[45] Date of Patent: Sep. 18, 1990

[54] OMNIDIRECTIONAL VARIABLE THRUST PROPELLER

[75] Inventors: Ronald S. Reich; Richard W. Uhrich, both of San Diego, Calif.

[73] Assignee: The United States of America as represented by the Secretary of the Navy, Washington, D.C.

[21] Appl. No.: 856,262

[22] Filed: Apr. 28, 1986

[51] Int. Cl.[5] ..... B63H 3/00

[52] U.S. Cl. ..... 416/115; 416/108; 416/109; 416/114; 416/113; 416/158

[58] Field of Search ..... 416/108, 109, 112, 113, 416/114–115, 158

[56] References Cited

U.S. PATENT DOCUMENTS

| | | | |
|---|---|---|---|
| 588,143 | 8/1897 | Hall . | |
| 2,394,846 | 2/1946 | Cox | 416/127 |
| 2,512,523 | 6/1950 | Fisher | 241/167 |
| 2,919,753 | 1/1960 | Hook | 416/158 X |
| 2,966,317 | 12/1960 | Ramniceanu | 244/20 |
| 2,984,306 | 5/1961 | Kottsieper | 416/108 X |
| 3,291,086 | 12/1966 | Haselton | 416/165 X |
| 3,323,598 | 6/1967 | Lindahl | 416/114 X |
| 3,450,083 | 6/1969 | Haselton | 114/16 |
| 3,703,211 | 11/1972 | Bernaerts | 416/245 A X |
| 3,805,723 | 4/1974 | Bernaerts | 416/32 X |
| 4,360,348 | 11/1982 | Demarco | 440/67 |

FOREIGN PATENT DOCUMENTS

| | | | |
|---|---|---|---|
| 75407 | 3/1983 | European Pat. Off. | 416/114 |
| 124901 | 3/1949 | Sweden | 416/114 |
| 201106 | 1/1966 | Sweden | 416/114 |
| 576876 | 4/1946 | United Kingdom | 416/114 |
| 791474 | 3/1958 | United Kingdom | 416/114 |

*Primary Examiner*—Donald P. Walsh

*Attorney, Agent, or Firm*—Harvey Fendelman; Thomas Glenn Keough

[57] ABSTRACT

An omnidirectional variable thrust propeller for a vehicle includes a hub, a plurality of blades, and a plurality of shafts. Each shaft is coaxially rotatably connected to a respective blade and extends through the hub at an acute angle to a hub longitudinal axis. Each shaft has a lever arm and an inner end portion which terminates inside the hub. A reciprocably moveable device engages the inner end portions of the blade shafts to uniformly rotate the blades in one direction when the device moves longitudinally in one direction and uniformly rotate the blades in an opposite direction when the device moves in an opposite direction to enable a change of thrust. Another device pivotally supports the reciprocably movable device at a variable acute angle to the longitudinal axis. Another device selectively move the reciprocably movable device about the pivot point to nonuniformly change the rotation or pitch of the blade that alters the propeller's thrust direction.

2 Claims, 2 Drawing Sheets

FIG. 2
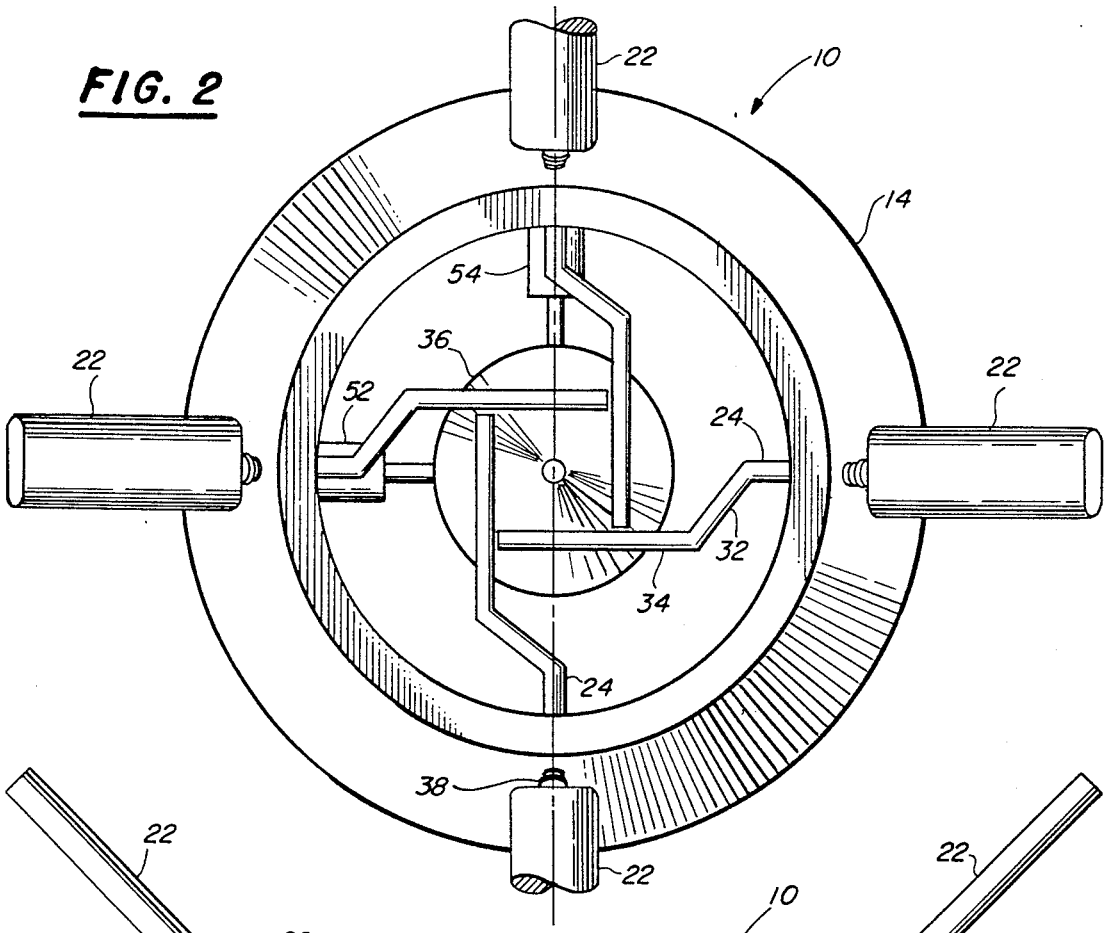
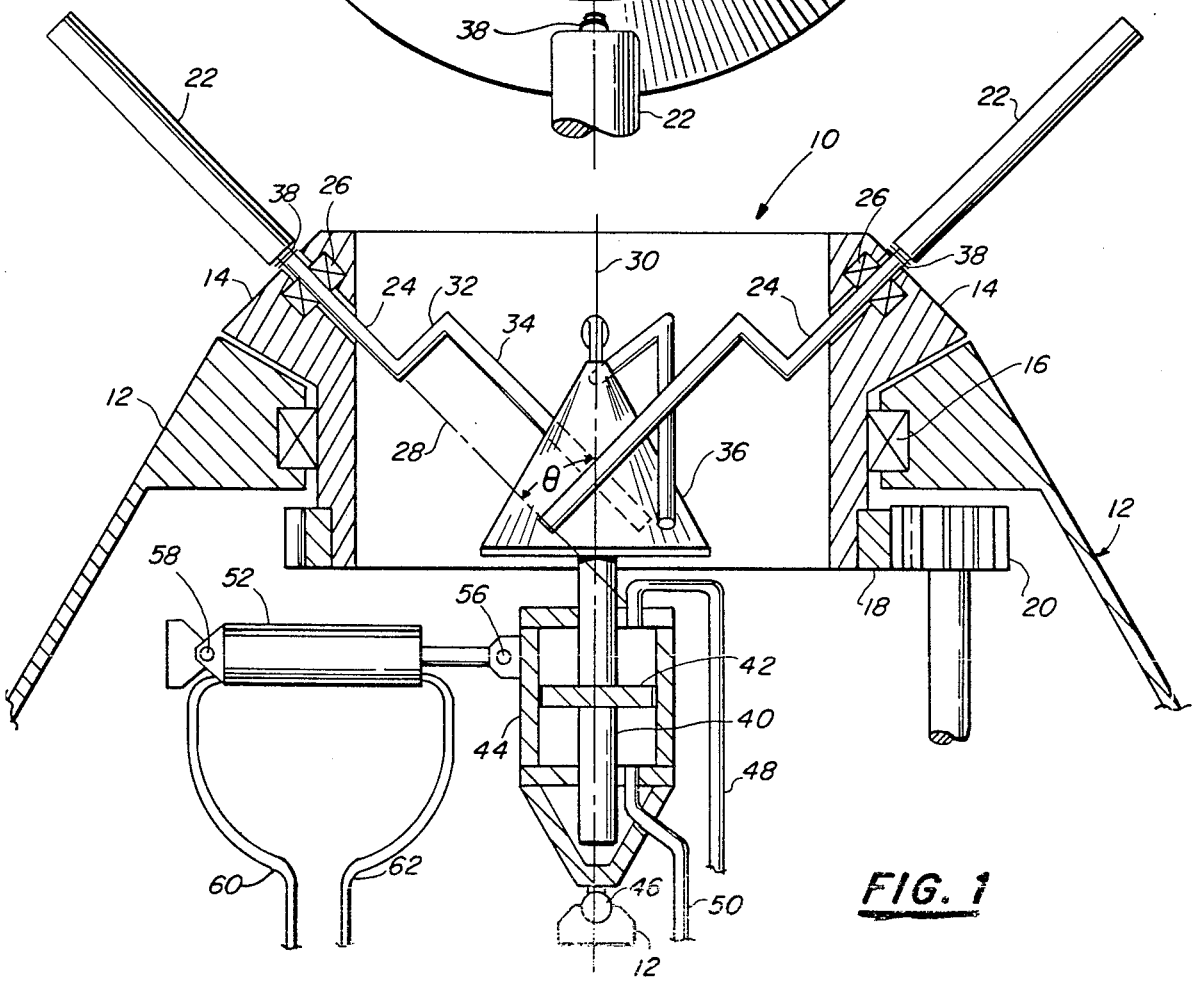
FIG. 1

FIG. 4
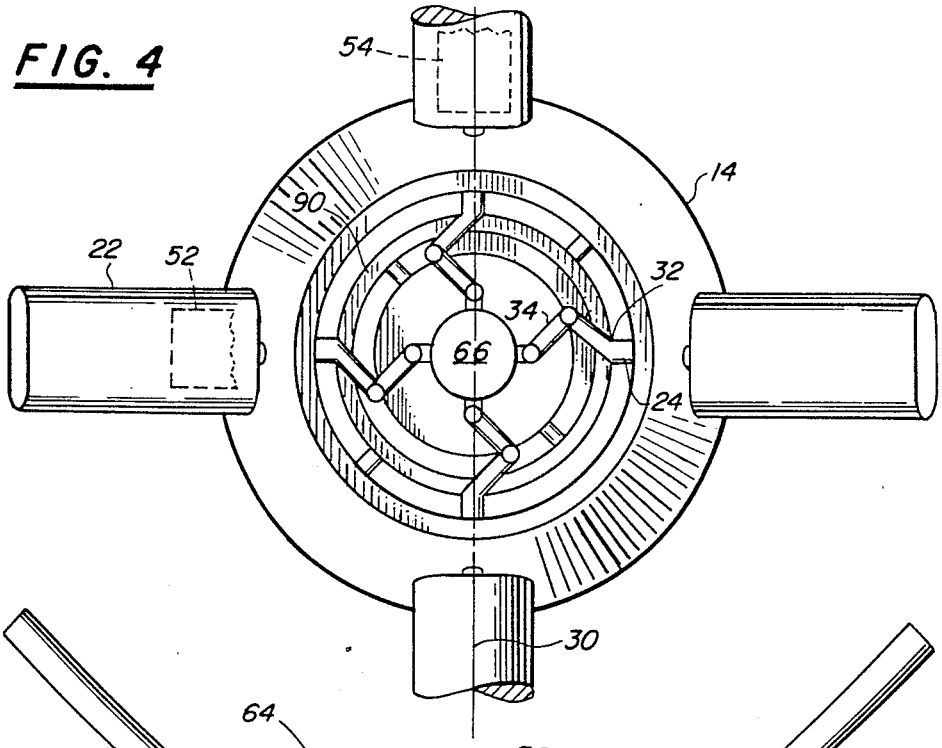
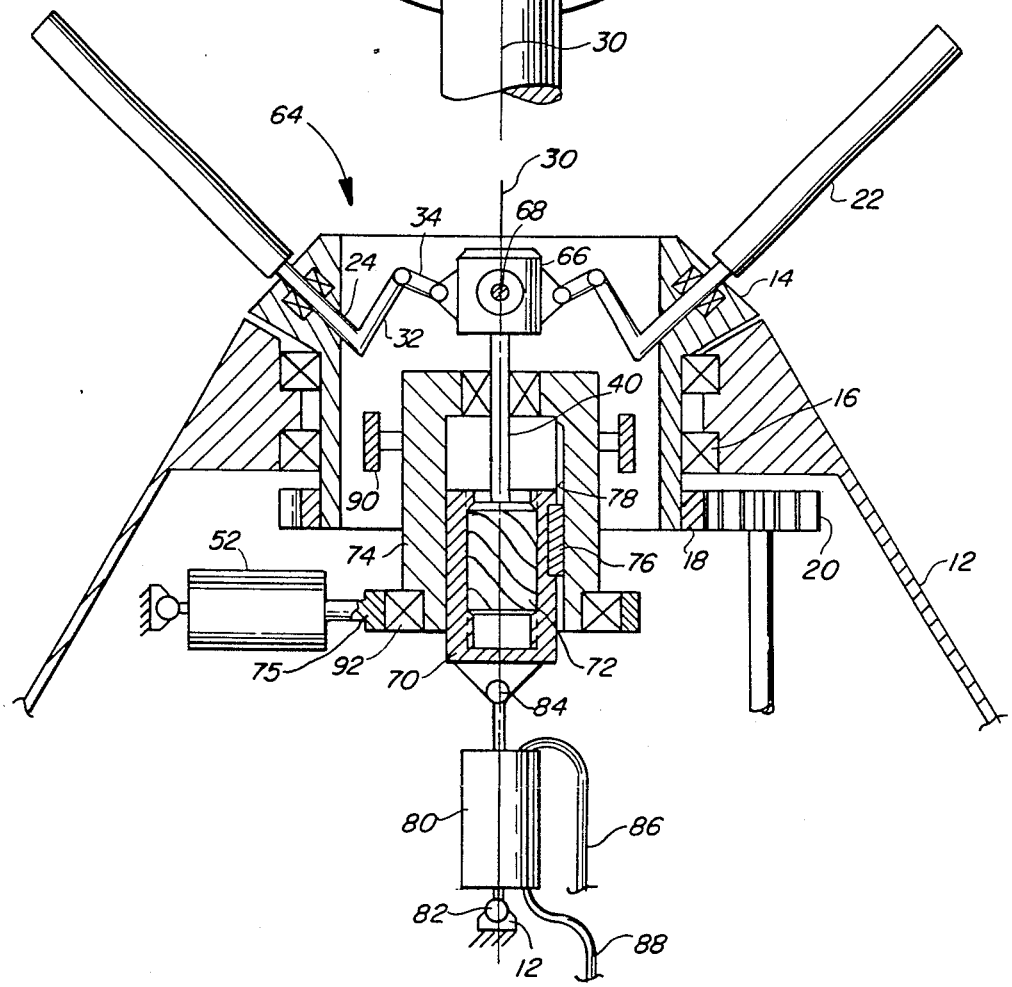
FIG. 3

OMNIDIRECTIONAL VARIABLE THRUST PROPELLER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The U.S. Navy has been one of the leaders in the conception, design and construction of underwater search vehicles. Most of these vehicles are configured to a rectangular form and have a combination of conventional thrusters for obtaining propulsion in any desired direction. Typically the thrusters are laterally spaced on the vehicle and can be canted or selectively reversed in their direction of thrust of obtain turning moments. These vehicles are not the optimum in efficiency since they are bulky and undergo a considerable amount of drag as they conduct their underwater searches. The most desirable configuration is a long narrow cylinder (torpedo shape). Such a shape minimizes propulsion energy and allows easy handling for launch and recovery. Unfortunately, the propulsion techniques utilized aboard the rectangular type of vehicles are not satisfactory for the torpedo shape. Even the propulsion means for a torpedo, which includes an aft mounted propeller and control surfaces, is not satisfactory because of the slow speed maneuvering required by a search vehicle. There is a need for a single propeller system which can obtain variable thrust in various directions for a torpedo-shaped type of search vehicle.

SUMMARY OF THE INVENTION

The present invention provides an omnidirectional variable thrust propeller which is especially adaptable for maneuvering a torpedo-shaped search vehicle, thus minimizing the propulsion energy required for a search. A hub, a plurality of blades, and a plurality of shafts have each shaft coaxially connected to a respective blade. Each shaft rotatably extends through the hub so that each blade is rotatable on a respective shaft which is at an acute angle to the longitudinal axis of the hub. Each has a lever arm and an inner end portion which terminates inside the hub. A device is provided for engaging the inner end portions of the blade shafts and is reciprocably movable along the lingitudinal axis of the hub. This movement uniformly rotates the blades in one direction or the other depending upon which way the reciprocably movable device is moving. Uniform rotation of the blades enables a change of the thrust force of the propeller. Another device is provide for pivotally mounting the reciprocably movable device to the vehicle at a point along the longitudial axis of the hub so that the reciprocably movable device can be pivoted for reciprocable movement at an acute angle to the longitudinal axis of the hub. A device is then adapted to be mounted to the vehicle for selectively moving the reciprocably movable means about the pivot point so as to enable a change of the direction of the thrust by rotating the blades nonuniformly. With the above arrangements, longitudinal movement of the reciprocably movable device along the longitudinal axis of the hub will vary the thrust of the propeller and the pivotal movement of the reciprocably movable means will vary the direction of the thurst.

OBJECTS OF THE INVENTION

An object of the present invention is to provide an omnidirectional variable thrust propeller.

Another objects is to provide a single propeller apparatus for an underwater vehicle which will vary the amount of and direction of thrust for maneuvering purposes.

A further object is to provide a power system for an underwater search vehicle which optimizes the power requirements for search purposes.

Still another object is to provide a single propeller for a torpedo shaped underwater search vehicle which is capable of efficiently powering the vehicle at various speeds in various directions of search.

Other objects, advantages and novel features of the invention will become apparent from the following detailed description of the invention when considered in conjunction with the accompanying drawings.

BRIEF DESCRIPTION OF THE DRAWINGS

FIG. 1 is a side view, partially in cross-section, of one embodiment of the invention.

FIG. 2 is a top full view of the FIG. 1 embodiment with the vehicle portion omitted.

FIG. 3 is a side view partially in cross-section of another embodiment of the invention.

FIG. 4 is a top full view of the FIG. 3 embodiment with the vehicle portion omitted and the gimbal assembly displaced 45°.

DESCRIPTION OF THE PREFERRED EMBODIMENTS

Referring now to the drawings wherein like reference numerals designate like or similar parts throughout the several views there is illustrated in FIG. 1 an omnidirectional, variable thrust propeller 10 for a vehicle 12, which vehicle may be of a long cylindrical shape (torpedo shape). The propeller 10 may include a hub 14 which is rotatably mounted on the vehicle 12 by a bearing 16 and which may be rotated about the longitudinal axis of the vehicle 12 by a ring and pinion gear 18 and 20, the latter being powered by a drive motor (not shown).

A plurality of blades 22 and a plurality of shafts 27 are provided, each shaft being coaxially connected to a respective blade. Each shaft rotatably extends through the hub 14 via a bearing 26 so that each blade is rotatable on a respective axis 28 which is at an acute angle $\theta$ to the longitudinal axis 30 of the hub 14 and vehicle 12. It is preferable that four blades 22 be utilized with the blades being spaced 90° apart about the longitudinal axis 30 of the hub, as seen in FIG. 2. Each shaft has a lever arm 32 and has an inner portion 34 which terminates inside the hub 14.

Means are provided for engaging the inner end portion 34 of the blade shafts, this means being reciprocably movable along the longitudinal axis 30 of the hub for uniformly rotating the blades 22 in one direction when the reciprocably movable means moves longitudinally in one direction and for uniformly rotating the blades 22 in an opposite direction when the reciprocably movable means moves longitudinally in an opposite direction. In the embodiment of the invention illustrated in FIGS. 1 and 2 the reciprocably movable means may include a frusto-conical shaped cam 36 positioned axially along the longitudinal axis 30 of the hub so that the inner end portions 34 of the blade shafts are engageable with the cam. In order to assure engagement a torsion spring 38 may be connected between the hub and each respective blade 22 for rotating the inner end portions 34 of the shafts into engagement with the cam 36.

The reciprocably movable means may further include a rod 40 which is coaxially connected to the cam 36, and means for supporting the rod 40 for reciprocable movement. The supporting means may include a piston 42 and a cylinder 44. The cylinder 44 may be pivoted to the vehicle at 46 and the rod 40 may be connected to the piston 42, as illustrated in FIG. 1. In order to selectively move the reciprocably movable means in one or the other of the reciprocal directions along the longitudinal axis 30 of the hub a pair of hydraulic lines 48 and 50 may be provided, the line 48 being connected into the top of the piston cylinder 44 and the line 50 being connected into the bottom of the piston cylinder. These lines 48 and 50 are connected to controls and a pump (not shown) for implementing movement of the piston 42 within the cylinder 44.

Means are also provided for pivotally mounting the reciprocably movable means along the longitudinal axis 30 of the hub 14 so that the reciprocably movable means can be pivoted for reciprocable movement at an acute angle to the longitudinal axis 30 of the hub. This pivotal mounting means may be the pivot 46, as illustrated in FIG. 1, which pivot allows the cylinder 44 to be positioned with its longitudinal axis nonaligned with the longitudinal axis 30 of the hub. This then places the cylinder 44 at an acute angle to the longitudinal axis 30 so that the reciprocal movement of the piston rod 40 and the cam 36 is likewise along the same acute angle to the longitudinal axis 30. Such reciprocal movement will nonuniformly rotate the propellers 22 so that the resultant thrust of the propellers is not along the longitudinal axis 30, but in contrast is at an angle threto. The result of such function is that the propellers will then exert a turning moment on the vehicle 12 when the hub 14 is rotated.

Means, which are adapted to be mounted to the vehicle 12, are provided for selectively moving the reciprocably movable means about the pivot point 46. The selective moving means may include a pair of linear actuators 52 and 54 which may each be pivotally connected at one end 56 to the cylinder 44 90° apart as taken about the longitudinal axis 30 of the hub. The other end of each longitudinal actuator may be pivotally connected at 58 to the vehicle, again 90° apart as taken about the longitudinal axis 30 of hub. The lineal actuators may be piston, piston rod and cylinder combinations with hydraulic lines 60 and 62 for driving the lineal actuator in a desired direction. The hydraulic lines for each lineal actuator extend to controls and a pump (not shown) so that each lineal actuator can be individually controlled to position the cam 36 in any desired acute angle to the longitudinal axis 30. With this arrangement a desired lateral thrust force component in any direction within a plane perpendicular to the logitudinal axis 30 can be obtained for directing the vehicle 12 along any desired course.

Another embodiment 64 of the omnidirectional variable thrust propeller is illustrated in FIGS. 3 and 4. The reciprocably movable means for this embodiment may include the rod 40, one end of the being pivotally connected to the inner end portions 34 of the shafts 24. The inner end portion 34 of each shaft may be pivotally connected at one end to the lever end portion 32 and may be pivotally connected at its other end to a linkage head 66. The linkage head 66 may in turn be fixed along a lateral axis to the rod 40 by a pin 68. The reciprocably movable means may further include a nut and screw combination 70 and 72 with the other end of the rod 40 being connected to the screw 72. A sleeve 74 is provide, and the put 70 may be slidably mounted in the sleeve for longitudinal movement only, any rotational movement being restrained by a key 76 located between the nut 70 and the sleeve 74, the key being reciprocable in a keyway 78. Means are provided for reciprocably moving the nut 70 within the sleeve 74. This reciprocably moving means may be an axial acutator 80 which has one end pivoted at 82 to the vehicle 12 and its opposite end pivotally connected at 84 to the nut 70. The axial actuator 80 may be hydraulically operated by lines 86 and 88 which extend to controls and a pump (not shown) for reciprocably moving the nut 70. When the nut 70 is moved in one direction or the other the pitch of the propellers 22 is uniformly changed when the movement is along the longitudinal axis 30 of the hub.

Means are provided for enabling reciprocal movement of the rod 40 along a direction which is nonaligned with the longitudinal axis 30 of the hub so as to obtain a differential pitch which provides a turning moment on the vehicle 12. This may be accomplished by mounting the sleeve 74 with a gimbal arrangement 90 to the vehicle 12. With this arrangement the sleeve 74 can be pivoted in any desired direction so as to obtain a vehicle turning moment in any desired direction. In order to implement these movements the pair of linear actuators 52 and 54 may be employed with their ends engaging a bearing 92 about the sleeve 74 via a ring 75. These actuators would operate in the same manner as described for the actuators 52 and 54 in FIGS. 1 and 2.

OPERATION OF THE INVENTION

In the FIGS. 1 and 2 embodiment when the can 36 is reciprocated along the longitudinal axis 30 the blades 22 are uniformly rotated to vary the thrust along the longitudinal axis 30 of the vehicle 12. When the cam 30 is aligned with the longitudinal axis 30 there is no turning moment and the vehicle 12 maintains a straight course. When it is desired to turn the vehicle 12, one or both lateral actuators 52 and 54 are operated to move the cam 36 off the longitudinal axis 30, which operation causes a nonuniform rotating of the blades 22 and a turning moment to be exerted on the vehicle 12.

In the FIGS. 3 and 4 embodiment the operation is the same as described for the FIGS. 1–2 embodiment.

Obviously many modifications and variations of the present invention are possible in the light of the above teachings. It is therefore to be understood that within the scope of the appended claims the invention may be practiced otherwise than as specifically describe.

What is claimed is:

1. An omnidirectional variable thrust propeller for an undersea vehicle comprising:

a rotatable hub having a longitudinal axis;

a bearing rotatably supporting the hub in the undersea vehicle in the longitudinal axis;

a ring gear mounted on the hub and a pinion gear mounted on the undersea vehicle to rotate the hub via the ring gear;

a plurality of blades each rotatably mounted in bearings in the hub;

a plurality of shafts each having a lever and an inner end portion terminating inside the hub and, each shaft coaxially connected to a respective blade that is rotatably mounted in the hub at an acute angle to the longitudinal axis;

means mounted on the undersea vehicle and engaging the inner end portions of the blade shafts for reciprocably moving along the longitudinal axis of the hub to uniformly rotate blades in one direction when the reciprocable moving means moves longitudinally in one direction and to uniformly rotate the blades in an opposite direction when the reciprocably moving means moves longitudinally in an opposite direction thereby enabling change of the thrust force of the propeller, the reciprocably moving means includes:

a nut and screw combination;

a rod, one end of the rod being pivotally connected to the inner end portions of the shafts the other end of the rod being connected to the screw;

a sleeve mounted in a gimbal connection to the vehicle;

the nut being slidably mounted in the sleeve; and a piston to reciprocably move the nut in said sleeve;

means mounted on the undersea vehicle for pivotally mounting the reciprocably moving means thereto at a point along the longitudinal axis of the hub to enable reciprocable movement thereof at an acute angle to the longitudinal axis of the hub; and means mounted on the undersea vehicle for selectively moving the reciprocably moving means about a pivot point to change the direction of thrust by rotating the blades nonuniformly, longitudinal movement of the reciprocably moving means along the longitudinal axis varies the blade's thrust and pivotal movement of the reciprocably movable means changes the direction of thrust.

2. A propeller as claimed in claim 1 in which the selectively moving means includes;

a pair of linear actuators which are connected to the sleeve 90° apart as taken about the longitudinal axis of the hub.

* * * * *